US007396077B2

(12) United States Patent
Boulva

(10) Patent No.: US 7,396,077 B2
(45) Date of Patent: Jul. 8, 2008

(54) SEAT STRUCTURE WITH ELASTIC SUSPENSION

(75) Inventor: Paul Boulva, Piedmont (CA)

(73) Assignee: 155124 Canada Inc., Ville d'Anjou, Québec (CA)

( * ) Notice: Subject to any disclaimer, the term of this patent is extended or adjusted under 35 U.S.C. 154(b) by 0 days.

(21) Appl. No.: 11/451,526

(22) Filed: Jun. 13, 2006

(65) Prior Publication Data

US 2007/0228798 A1 Oct. 4, 2007

(30) Foreign Application Priority Data

Mar. 31, 2006 (CA) ..... 2541583

(51) Int. Cl.
*A47C 7/14* (2006.01)

(52) U.S. Cl. ..... 297/284.2

(58) Field of Classification Search ..... 297/284.2
See application file for complete search history.

(56) References Cited

U.S. PATENT DOCUMENTS 3,258,259 A * 6/1966 Nils ..... 297/284.2 X
4,712,834 A * 12/1987 Warrick ..... 297/284.2
4,858,992 A * 8/1989 LaSota ..... 297/284.2
5,058,952 A * 10/1991 LaSota ..... 297/284.2
5,338,091 A 8/1994 Miller
5,393,126 A 2/1995 Boulva
5,823,620 A * 10/1998 Le Caz ..... 297/284.2 X
6,361,117 B1 3/2002 Tate
6,609,753 B2 * 8/2003 Schmidt-Schaeffer .... 297/284.2
6,623,079 B2 9/2003 Gregory
6,672,666 B2 * 1/2004 Stiller et al. ..... 297/284.2
6,811,218 B2 * 11/2004 Deimen et al. ..... 297/284.1
6,814,407 B2 * 11/2004 Mundell ..... 297/284.2 X

FOREIGN PATENT DOCUMENTS

FR 2587201 A1 * 3/1987 ..... 297/284.2
GB 2035792 A * 6/1980 ..... 297/284.2

* cited by examiner

*Primary Examiner*—Rodney B. White
(74) *Attorney, Agent, or Firm*—Ogilvy Renault LLP

(57) ABSTRACT

A seat structure is comprised of a support frame having an elastic fabric sheet secured to the frame along opposed lateral sides of the frame and extends across a top seating portion or front part of a backrest thereof. In one embodiment of the invention one or two extensor members are displaceably positioned between the frame and the elastic fabric sheet to a permanent tensioning position where the elastic fabric sheet undergoes an upward displacement and stretching sufficient to support an intended load, herein a user person, thereon or thereagainst in a flexible suspension in the seating or backrest portion and free from contact with any hard surfaces.

16 Claims, 8 Drawing Sheets

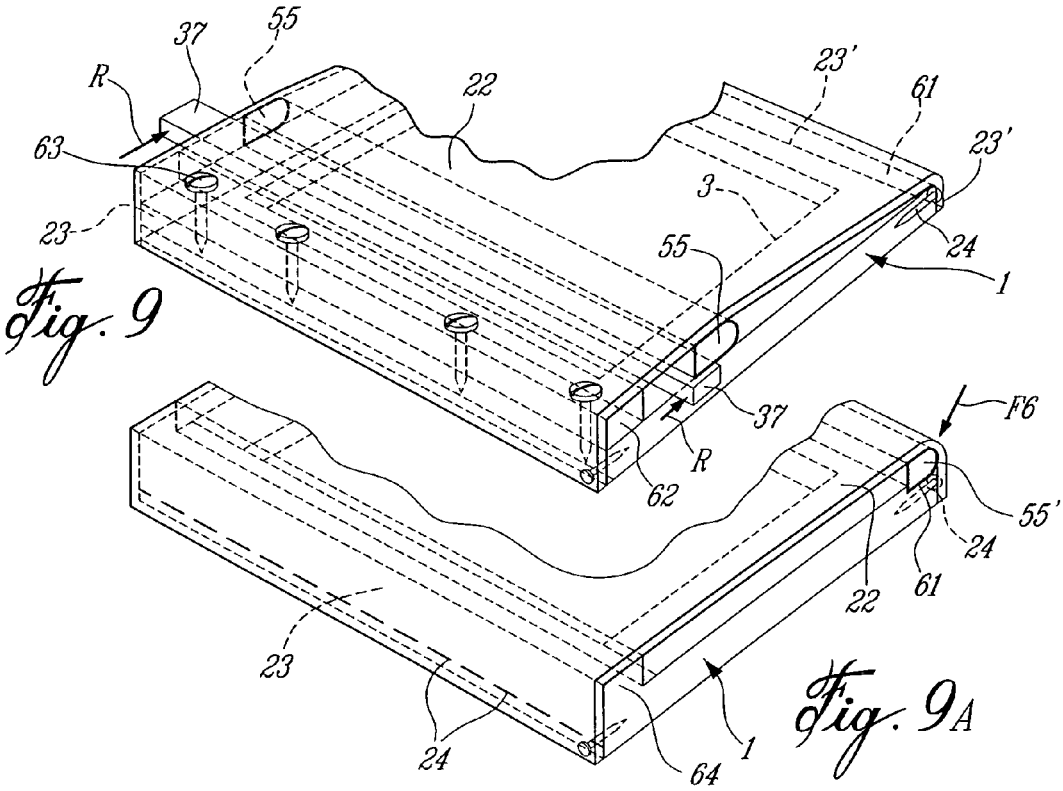
Fig. 9
Fig. 9A
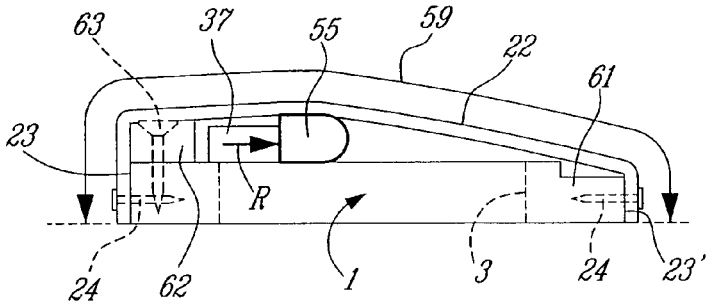
Fig. 9B
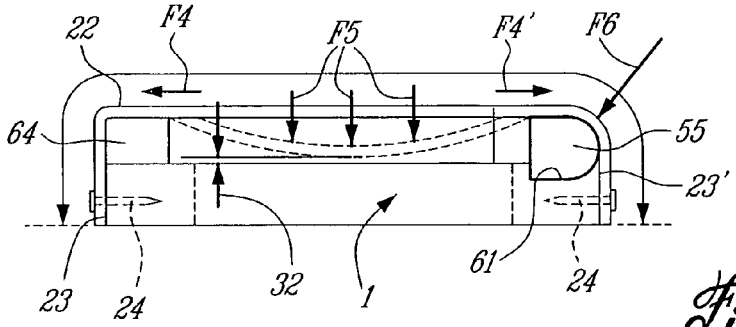
Fig. 9C

SEAT STRUCTURE WITH ELASTIC SUSPENSION

TECHNICAL FIELD

The present invention relates to a seat structure having an elastic fabric sheet which is placed in tension and in an elevated position over a seating portion of a support frame sufficient to support an intended load thereon in suspension over the seating portion free from contact with any hard surfaces. The invention also relates to a chair comprising a seat structure as well as a backrest structure having an elastic fabric sheet which is positioned and tensioned in a like manner as the seat structure.

BACKGROUND ART

In the prior art, U.S. Pat. No. 5,393,126 describes a chair tubular frame which has a seating portion and a backrest portion connected thereto and wherein a sleeve of fabric material is slipped over the frames from an end thereof. The frames are tapered in order to slip the fabric sleeve thereover and the tension in the frame causes the sleeve to be held taut thereabout. The tapered frame is essential and therefore restricts the shape of the chair seat or backrest fabricated thereby. The chair is also difficult to fabricate as the sleeve needs to be pulled over a tensioning frame and positioned at a precise location thereon. This seating structure requires a rigid bridge support under the tensioning frame and a plate to connect to a central support post.

Another commonly known prior art seating construction is, where the seating structure, seat or backrest, is covered directly with a foam material. This foam material eventually compresses under a user's weight and the user person will eventually feel the hard seating structure underneath the foam.

U.S. Pat. No. 6,361,117 also teaches an elastic suspension for a seat structure wherein a web of elastic fabric is held in a stretched form within the seat frame to add comfort to a person sitting on a seat formed with the assembly. Further examples of stretch fabric frames are taught in U.S. Pat. Nos. 5,338,091 and 6,623,079.

SUMMARY OF INVENTION

It is a feature of the present invention to provide a seat and/or backrest structure for a chair using a single elastic fabric sheet which is stretched to create a flexible suspension tension bridge whereby the deflection of the elastic fabric sheet under the weight of a seated person, and in the entire surface of the canvas, will maintain the user person in suspension and free from contact of any hard seating structure thereunder.

Another feature of the present invention is to provide a seat and/or backrest structure which uses a single elastic fabric sheet which is placed under tension by displaceable extensor members which displace the elastic fabric sheet away from its support frame and simultaneously stretch the sheet to place it under tension.

Another feature of the present invention is to provide a seat and/or backrest structure for a chair construction and wherein each of the structures utilizes a single elastic fabric sheet secured to the frame across opposed sides thereof and placed under tension by the memory of the frame which has been flexed whereby the elastic fabric sheet can be tensioned and spaced from any hard surface of the frame by a restoring force provided by the flexed frame which is under tension whereby an intended load placed on the stretched fabric sheet is held in suspension.

According to a further feature of the present invention the elastic fabric sheet is placed under tension by both the extensor members and the flexion of the support frame placed under tension.

According to the above features, from a broad aspect, the present invention provides a seat structure comprising a support frame. A single elastic fabric sheet is secured to the frame along opposed lateral sides of the frame and extends across a top seating portion of the frame. Tensioning means is provided to stretch the elastic fabric sheet and position same at an elevated position above the seating portion sufficient to support an intended load thereon in suspension over the seating portion.

According to a further broad aspect of the present invention there is provided a chair comprising a seat structure and a backrest structure. The backrest structure has a single elastic fabric sheet secured along opposed lateral sides thereof and extending across a back support front portion of the backrest structure. Tensioning means is provided to stretch the elastic fabric sheet and position same spaced forwardly of the front portion of the back support portion sufficient to maintain an intended load thereon in suspension.

According to a still further broad aspect of the present invention there is provided a seat and a backrest structure as above described and wherein the tension in the stretched elastic fabric sheet can be made variable whereby the fabric sheet exhibits a tension which is different in different portions thereof.

BRIEF DESCRIPTION OF DRAWINGS

A preferred embodiment of the present invention will now be described with reference to the accompanying drawings in which:

FIG. 9 is a perspective view, partly fragmented, and wherein a permanent extensor is secured to the seat support frame and a displaceable extensor is used to displace and bias the single elastic fabric sheet under tension spaced above the seat frame;

FIG. 9A is a fragmented perspective view showing a still further embodiment and wherein an extensor member is formed integral with the seat support frame;

FIG. 9B is a side cross-section view of FIG. 9;

FIG. 9C is a side cross-section view of FIG. 9A showing the tension forces applied in the single elastic fabric sheet;

DESCRIPTION OF PREFERRED EMBODIMENTS

Figure 1:
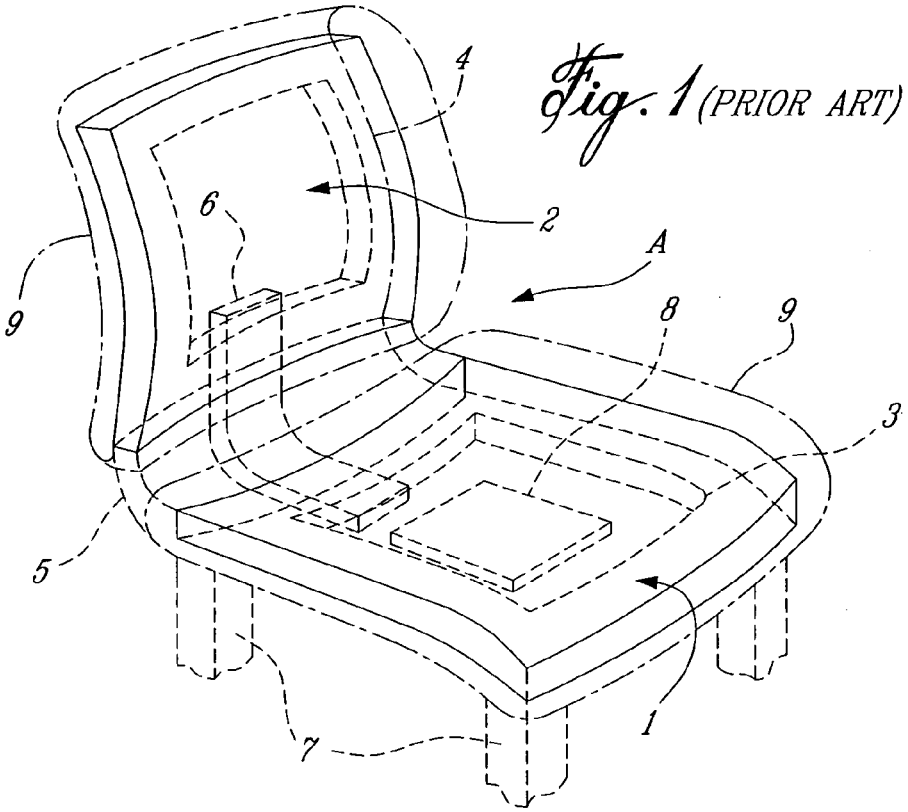
Fig. 1 (PRIOR ART)
FIG. 1 is a perspective view illustrating a prior art chair fabricated with a seat and backrest structure without a suspension and adapted to receive foam padding directly on the rigid structure.
Figure 1A:
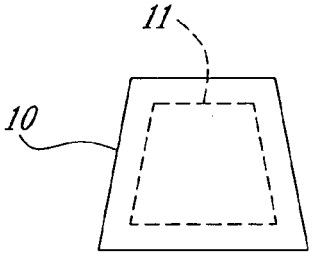
FIGS. 1A, 1B and 1C are plan views showing different configurations and shapes of a seat or backrest structure.

Referring now to the drawings and more particularly to FIG. 1, there is shown a chair structure A of the prior art which is herein provided with four legs 7 or which may be mounted on a center pedestal 8. The chair A is comprised of a seat support frame 1 and a backrest support frame 2 which may have straight or curved solid plane surfaces 21 or 20 (see FIGS. 1D and 1E) or may consist of contour frames 3 and 4, respectively. The seating or backrest frames 1 and 2 may be secured together with an attachment bracket 6 or may be formed as a continuous frame as indicated by phantom lines 5. Both the seat and backrest support frames are usually covered with a foam material such as illustrated by reference numeral 9.

Figure 1B:
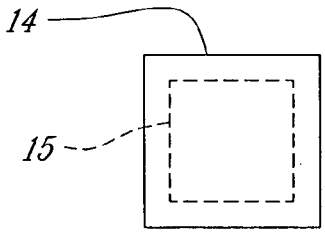
Figure 1C:
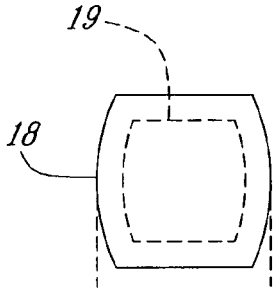
Figure 1D:
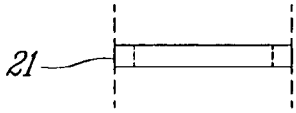
FIG. 1D is an end view showing the structures of FIGS. 1A to 1C as being straight flat structures.
Figure 1E:
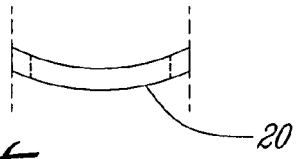
FIG. 1E is an end view similar to FIG. 1D but showing the structures provided with a concavely curved plane surface.

FIGS. 1A to 1E illustrate in plan view and end views different possible configurations and shapes of the seat or backrest support frames which can be used with the present invention. Reference numeral 10 illustrates a tapered frame which may also be formed by a solid frame structure or be formed as a hollow frame structure, as illustrated by reference numeral 11. It may have a flat or a curved configuration as illustrated by reference numerals 21 and 20, respectively, in FIGS. 1D and 1E. The frame 14 of FIG. 1B is a rectangular frame 14 and which may also be formed as a hollow frame as depicted by phantom lines 15. The frame of FIG. 1C may have curved side edges as illustrated by reference numeral 18 and may also be a hollow frame as indicated by reference numeral 19.

Figure 2:
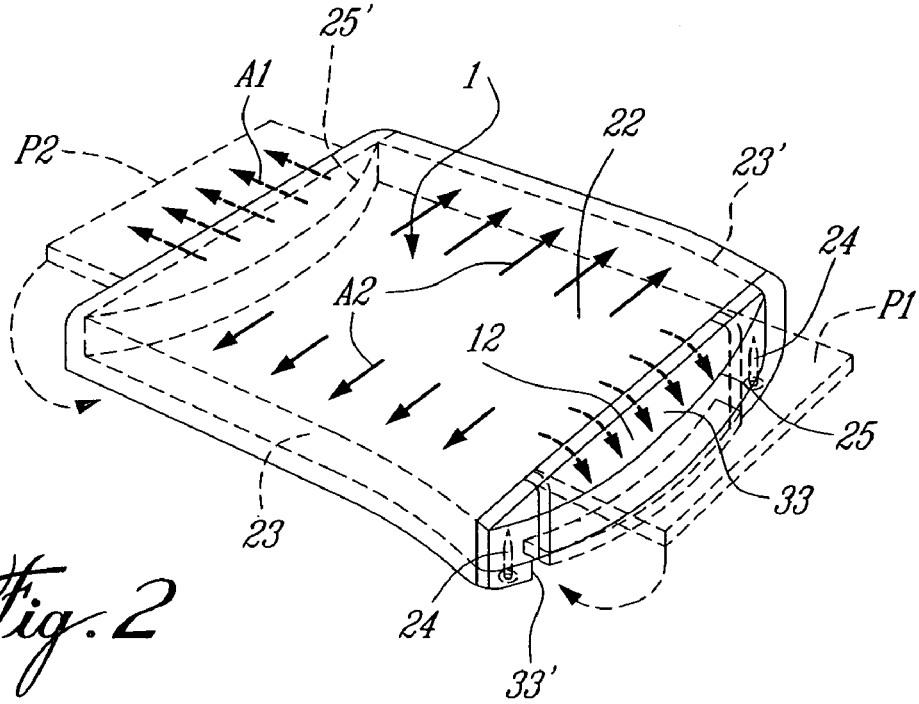
FIG. 2 is a perspective view showing a seat frame and elastic fabric sheet constructed in accordance with the present invention.

As shown in FIG. 2, a single elastic fabric sheet 22 is attached securely and permanently, with staples 24 or other types of fastening means, to the underside 33' of the seat support frame 33 and all along the lateral sides 23 and 23' thereof. The elastic fabric sheet 22 is a woven textile fabric formed of high strength elastic filaments. As hereinshown, the single elastic fabric sheet 22 is held in tension across the seating portion 12 by tensioning means which is herein constituted by tension exerted by a pre-stressed seat support frame 33. The frame may be constructed of plywood, hardwood, molded plastic, fiberglass, or flexible steel but a material capable of retaining its shape so that when the frame is bent, its memory will apply a restoring force and tension the fabric sheet 22.

Figure 2A:
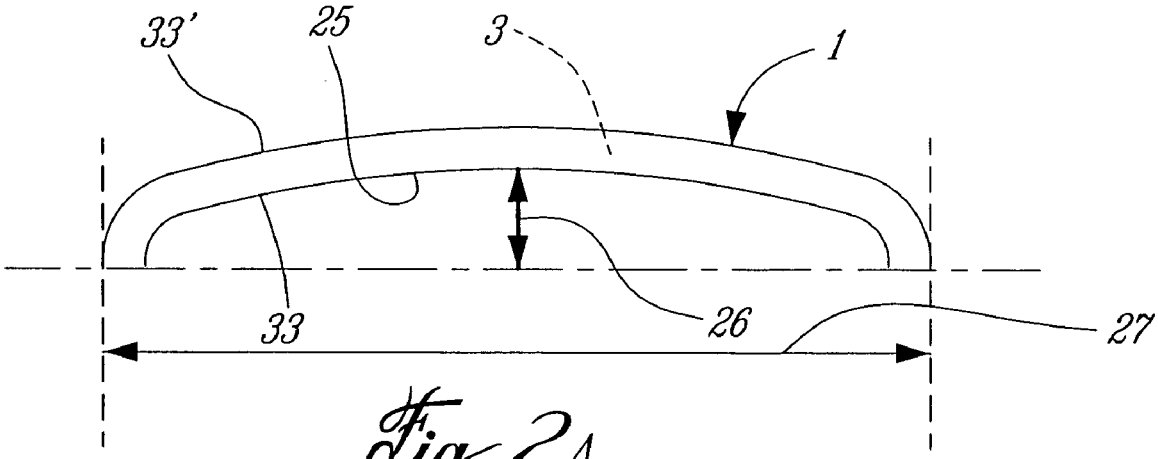
FIG. 2A is a cross-section view showing an example of a curved backrest or seat structure.
Figure 2B:
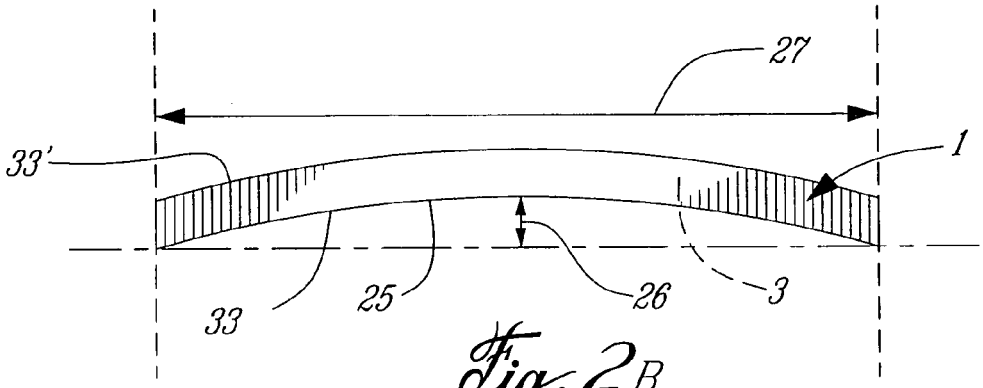
FIG. 2B is a cross-section view showing and example of a curved backrest or seat structure.

With reference to FIGS. 2, and 2A to 2C, there is shown the manner in which the elastic fabric sheet 22 is stretched and placed under tension. As shown in FIGS. 2A and 2B, which are front end views of two possible curved chair structures turned upside down, these seating (FIG. 2B) or backrest (FIG. 2A) structures have a predetermined total side-to-side width 27 and a center of curvature distance 26 from a straight support surface.

Figure 2C:
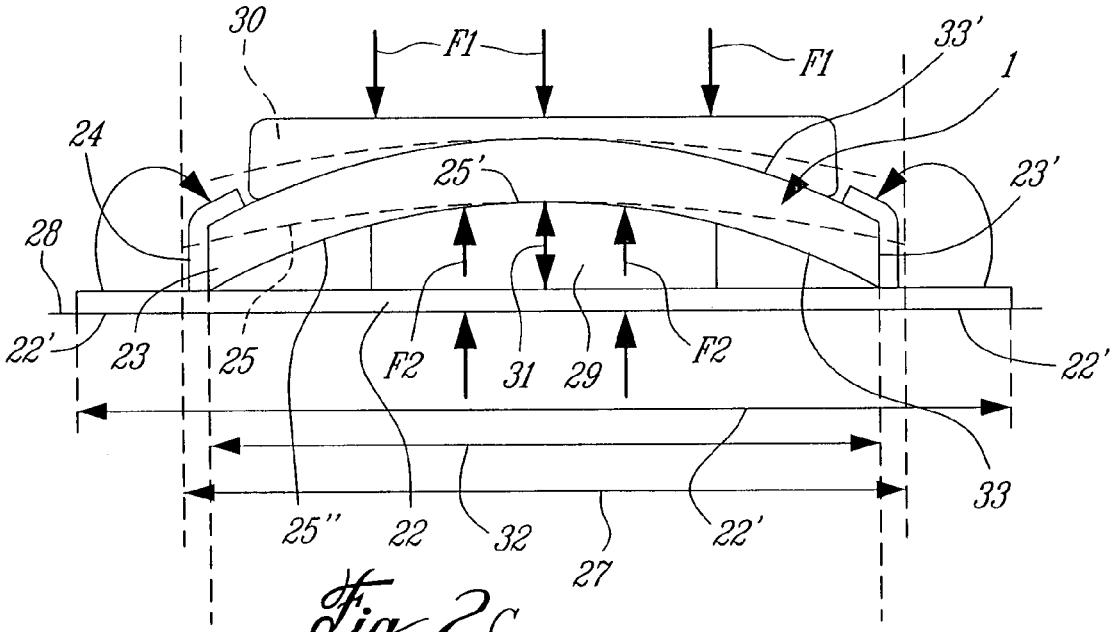
FIG. 2C is a sectional end view showing how the curved seat structure of FIG. 2B is biased in tension and the single elastic fabric sheet is secured thereto.

As shown in FIG. 2C, a single sheet of elastic fabric material 22, herein a stretchable elastic canvas sheet, having a predetermined width 22' is placed on a flat work surface 28. A forming block 29, having a determined height 31 and a curved top surface with a smaller radius 25' than that of the radius 25 of the seating structure 1 is centered on top of the elastic canvas material 22. The seating frame 3 is placed curved down and maintained in the middle and over the forming block 29. A curved pressure forming block 30, having a curved underside which is the same as the curve of the top surface of the forming block 29, is lowered by a strong uniform force F1 on the seating structure 3 in order to bend or curve the flexible seating structure 3 to assume a new curvature 25" having a smaller radius than its previous curvature 25, as herein illustrated in dotted line. By bending the frame structure 3 the width thereof will become smaller, as herein illustrated by reference numeral 32, than its previous width 27 and also the structure will have a higher center of curvature distance 31 than its original distance 26, as shown in FIG. 2B. The seating structure 3 is curved under pressure so both its lateral opposing sides 23 and 23' touch and hold in place the elestic canvas sheet 22. The exterior ends 22' of the canvas sheet 22 are then bent over the opposed lateral sides 23 and 23' and attached tightly and permanently to the sides or on the back face 33' of the seating structure 3 by the use of fasteners such as staples 24.

Figure 2D:
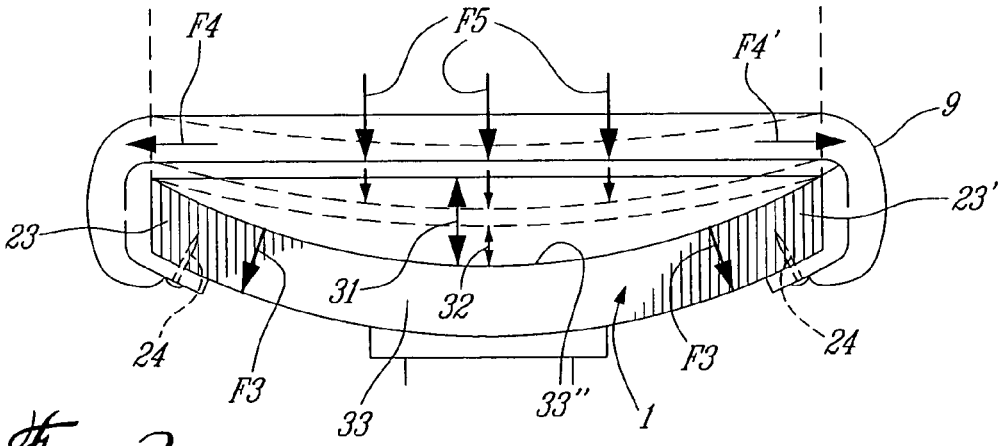
FIG. 2D is a cross-section view showing how the single elastic fabric sheet is placed in tension by the biasing restoring force of the seat structure bent or biased as shown in FIG. 2C.

As shown in FIG. 2D, when the pressure of the forming block is released, the frame's memory will exert a constant restoring force F4 and F4' on the elastic fabric sheet pulling it constantly towards its opposing lateral sides as the strong flexible seating structure or backrest structure continues to retrieve its original shape or curve and generating a restoring force as shown by arrows F3. The center curvature distance 31 between the structure and the elastic fabric sheet placed in tension is pre-calculated and predetermined based on a predetermined load, whereby a heavier person having a maximum weight F5, will never deflect the elastic fabric sheet sufficiently to touch or feel the upper surface 33" of the seating structure. In the construction of such seat structure or backrest structure, a further distance 32 is calculated in the design in order to accept loads exceeding the maximum specified load of the chair constructed with such a structure. A layer of foam material 9 may be added for optimum and superior comfort requirements depending on the chair design.

With reference to FIG. 2, it can be seen that the elastic fabric sheet can be provided with extension panels P1 and P2 to overlap the front and rear edges of a seat or backrest frame and secured thereunder. These extension panels can also tension the elastic fabric transversely, as indicated by arrows A1, to the lateral side tension, as indicated by arrows A2.

Figure 3:
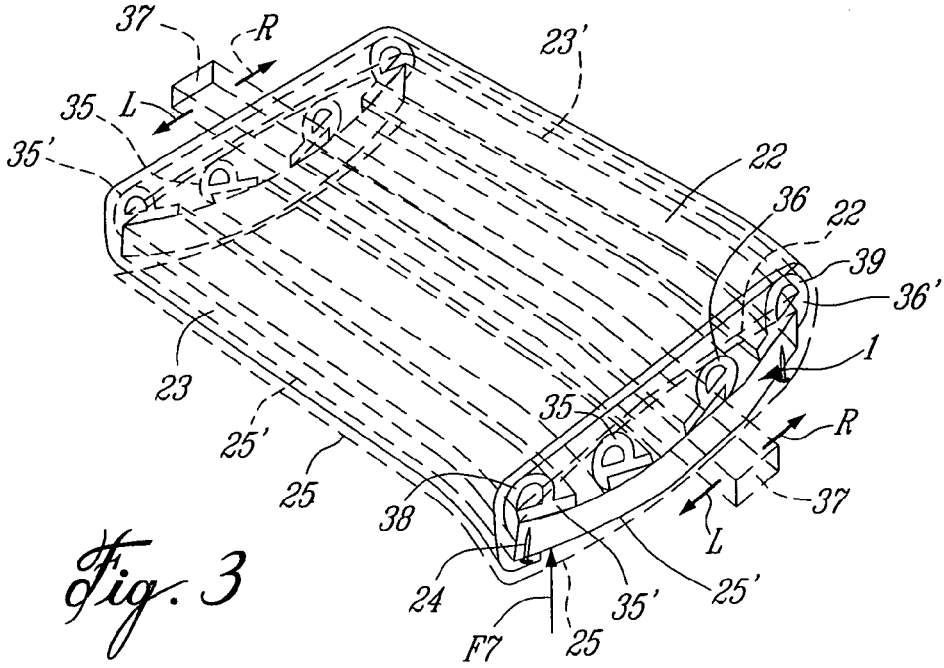
FIG. 3 is a perspective view showing a first example of extensor members being positioned for engagement with the opposed lateral sides of a seat support frame having a concave top surface.
Figure 3A:
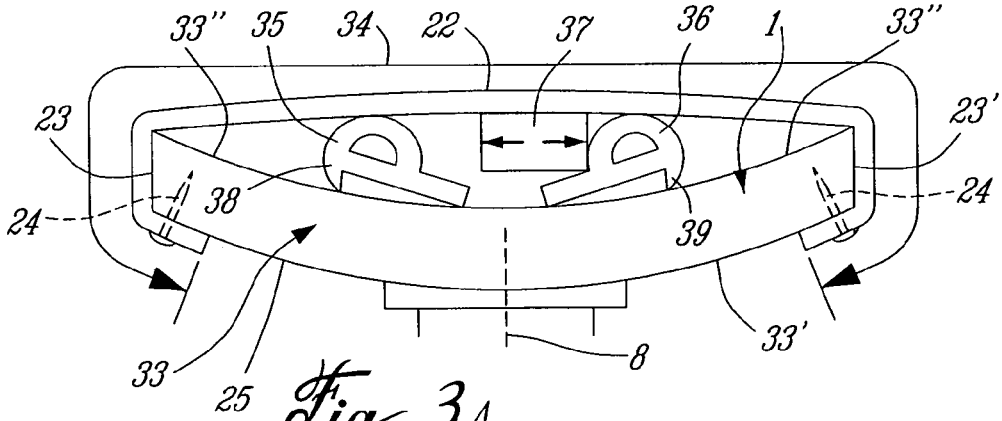
FIG. 3A is an end view of FIG. 3 showing the extensors in position before being engaged with the lateral sides and the manner in which the extensors are displaced to displace and tension the single elastic fabric sheet.
Figure 3B:
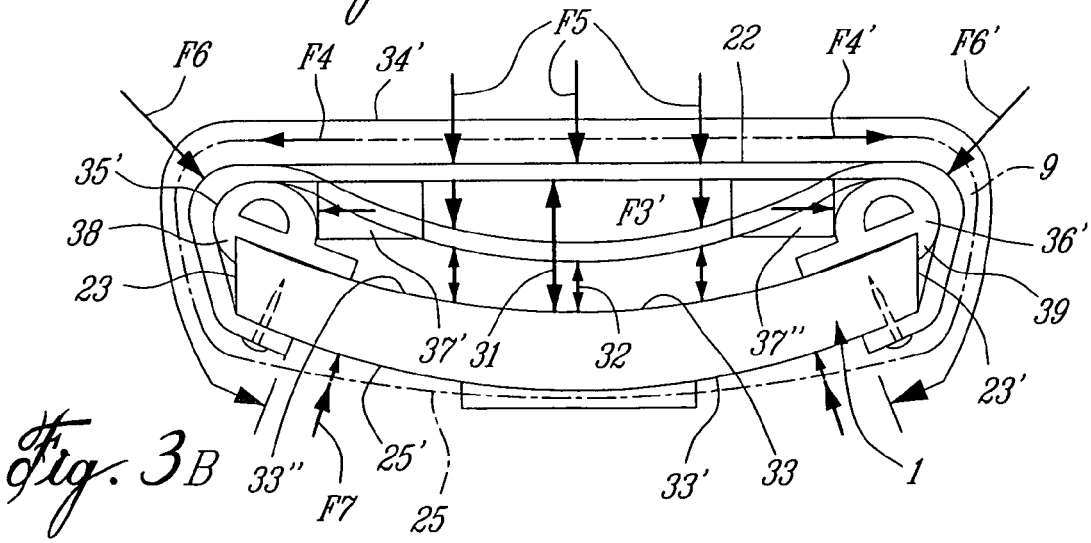
FIG. 3B is an end view showing the extensor members in a permanently engaged position and the tension forces generated by the single elastic fabric sheet when placed in tension and displaced by the extensor members.

Referring now to FIGS. 3 to 3B, there is shown a further tensioning means to stretch the elastic fabric sheet and position same at an elevated position above the seating portion of the frame or backrest frame to support an intended load thereon in suspension. As hereinshown a sheet of elastic fabric material 22 having a precise width as illustrated by the double ended arrow line 34, is securely attached and maintained permanently with staples 24 or other fastening means on the underface 33' of the frame about the opposed lateral sides 23 and 23' thereof. The sides may be curved or may be straight sides. The single elastic fabric sheet 22 has been secured to the frame but has not yet been stretched. However, the elastic fabric sheet 22 is spaced from the top surface of the frame or loose thereover to permit the insertion of one or more extensor members 35 and 36 thereunder and over the upper surface 33" of the frame 33. As hereinshown there are two identical extensor members 35 and 36 having hook sections 38 and 39 formed integral therewith. The extensor members have the same length as the seating structure sides. A hard rigid bar or steel blade 37 is introduced between the two extensor members 35 and 36 to push these members with sufficient force, L and R, toward their respective left and right lateral sides 35' and 36' until their downward hooks 38 and 39 snap in permanent engagement with the upper edge of the lateral sides 23 and 23'. The solid bar 37 is then easily removed. The extensor members 35 and 36 as herein illustrated may be constructed of a low flexible, semi-rigid, strong material like a PVC plastic extrusion. These extensor members can then adjust to the shape and curves of the opposing side edges of the seat structure when placed in their final engaged position as shown in solid lines at 35' and 36'.

As the extensor members are slid and positioned in engagement with their respective lateral edges of the frame, the suspension elastic fabric sheet 22 is put into tension and stretched by the lateral exterior forces F4 and F4' resulting from the displacement exerted by the extensor members. As the extensor members are moved to their engaged position, they displace the fabric sheet 22 upwards to assume a different stretched position from its original position and forcing the elastic fabric sheet to stretch and elongate in width to a longer stretch width 34' and forcing by its force F7 the seating frame to curve and flex slightly from its original straight or curved shape 25 to a new increased curved shape 25'. The seating structure thus also exerts a continuous and permanent force F7 to retrieve its original shape due to its memory while contributing stretching by its force F4 on the elastic fabric sheet. Accordingly, the elastic fabric sheet 22 is placed in tension both by the extensor and the deformation in the support frame.

The strong and firm seating or backrest structure constructed in accordance with the present invention, is selected from a material having some kind of memory elasticity and flexibility in order to exert a restoring force when bent thereby adding to the stretching of the elastic fabric sheet 22 which is secured across the opposed lateral sides of the support frame. When the elastic fabric sheet is stretched to its final position, it applies at the same time a permanent diagonal force F6 and F6' on the extensor members whereby they remain permanently anchored in their engaged position with the top edge of the lateral sides 23 and 23' of the frame.

It is also possible to first position one of the extensor members in its final position without using any forces so only the second extensor member has to be forced and slid to its final engaged position at its associated lateral edge or side of the frame. The predetermined width 34 of the elastic fabric sheet would permit this option as long as the fabric sheet width may be stretched firmly in its final width 34' by the second extensor member and as long as the fabric sheet may be put into sufficient tension to ensure that a seated person, exerting a force F5 on the elastic fabric sheet, never reaches the top surface 33 of the seating structure and that there is still and always a remaining center curvature distance 32 between the loaded elastic fabric sheet 22 and the top surface 33 of the seating structure under maximum normal load of a person seated thereon. Such will be described later.

Figure 4:
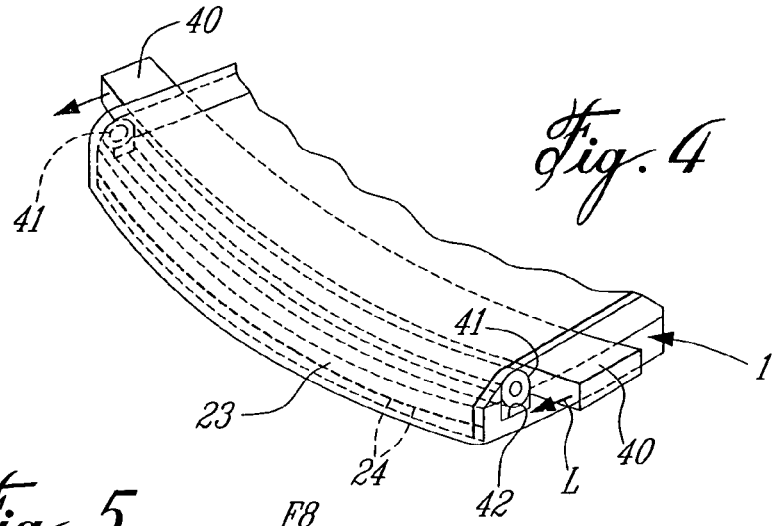
FIG. 4 is a fragmented perspective view showing another example of an extensor member being secured adjacent the lateral sides of the seat support frame and which sides are curved sides and wherein the extensors are flexible extensors capable of deforming when in contact with a curved placement bar whereby to position same in a curved retention groove disposed adjacent and parallel to the lateral sides of the seat support frame.

Referring now to FIG. 4, there is illustrated the same principle as in FIG. 3 but wherein the seating structure may have exteriorly or interiorly curved lateral sides 23 and 23' as shown by the shape as illustrated in FIG. 1C. The tensioned elastic fabric sheet 22 is attached permanently with staples 24 or other fastener elements to the two curved lateral sides 23 and 23' of the seating structure 1. As hereinshown, the straight extensor member 41 may be made of flexible high density plastic tubing, which is an extrusion cut to length, so they may flex lightly in all directions. A curved rigid bar 40 having about the same curvature as the retention groove 42 formed adjacent the opposed curved lateral sides, pushes the tube extensor member 41, forcing it to curve until it reaches and snaps into the curved retention groove 42 formed adjacent the opposed lateral sides 23 and 23' of the frame. The grooves 42 have a predetermined depth whereby to receive a lower portion of the tubular extensor 41 therein. When the elastic fabric sheet 22 is stretched by the extensor members 41, the elastic fabric sheet applies a permanent pressure on the extensor tubes 41 so that they remain permanently captive in position in their respective grooves 42.

Figure 5:
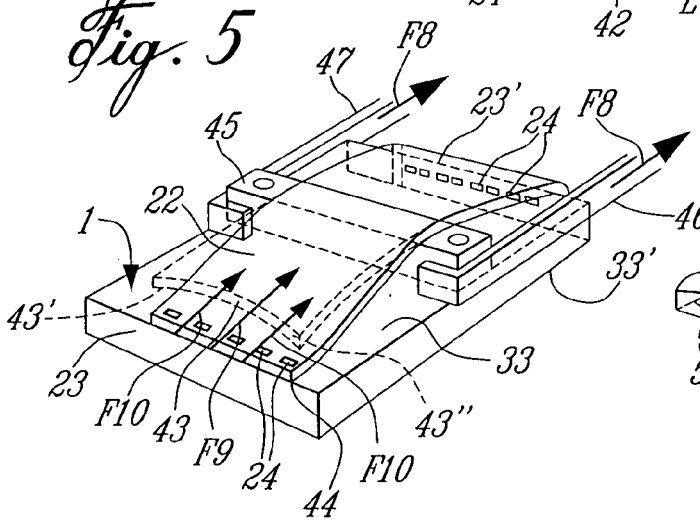
FIG. 5 is a perspective view showing a still further embodiment and wherein the single elastic fabric sheet is provided with opposed curved edges which are secured to opposed lateral sides of the seat support frame along straight lines and when placed in tension exhibits a variable tension in its surface.

FIGS. 5, 6, 7A and 7B show various modifications of the shape of the single elastic fabric sheet 22 and the extensor members whereby the elastic fabric sheet is placed under variable tension forces in different regions thereof. As shown in FIG. 5, the lateral sides of the fabric sheet 22, shown in phantom lines, are cut with an inward curve 43 whereby the fabric sheet is shorter in the middle and wider at its extremities 43' and 43". This curved edge is attached permanently along straight lines by staples 24, as herein illustrated, against the top edge of the lateral sides 23 and 23' or on the underside surface 33' of the seating structure 1 as previously described. When the extensor member 45 is pulled by the force F8 of an assembly mechanism, by engaging hook arms 47 and 46, to its final biasing position and permanently maintained in that position by an associated retention means, the stretched elastic fabric sheet 22 will have more tension force F9 from side-to-side in its middle position where the sheet is shorter and less tension force F10 in its adjacent side portions where the fabric sheet is longer.

Figure 6:
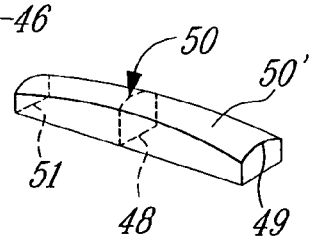
FIG. 6 is a perspective view showing a still further example of the construction of an extensor member and wherein the extensor member has a curved dome-shaped upper surface whereby to apply a variable tension in the elastic fabric sheet.

FIG. 6 shows a further example of the construction of an extensor member to generate a variable tension in the fabric sheet. As shown, the extensor member 50 is an elongated rigid rod-shaped member having a convexly shaped top surface 50' wherein the middle section 48 is thicker than the opposed end portions 49 and 51 in order to impart a variable tension in the elastic fabric sheet when placed under tension, in a manner as previously described.

Figure 7A:
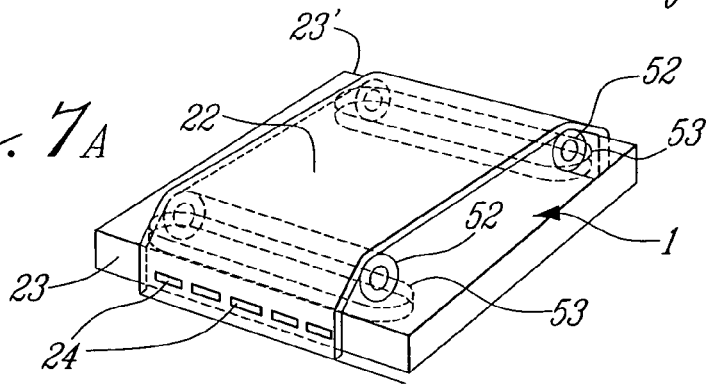
FIG. 7A is a perspective view showing a still further embodiment wherein the extensors are tubular extensors which are positioned in straight retention grooves adjacent the opposed lateral sides of the seat support frame.
Figure 7B:
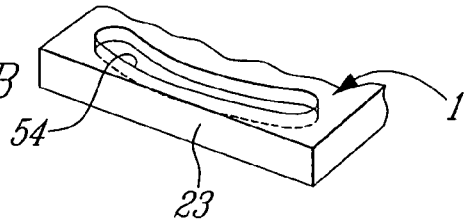
FIG. 7B is a fragmented perspective view illustrating the retention grooves as being curved retention grooves whereby the extensors of FIG. 7A are curved to apply a variable tension in the single elastic fabric sheet.

FIG. 7 shows another embodiment wherein two tubular extensor members 52 are positioned in straight opposing side retention grooves 53. These extensors 52 are placed and positioned in the same manner as previously described with respect to FIG. 4 with the exception that these extensors are positioned in straight retention grooves. As shown in FIG. 7B, the groove may also be curved in order to apply variable tension in the elastic fabric sheet. When located in the curved groove 54 more tension will be applied to the central portion of the elastic fabric sheet than its opposed side regions due to the curve in the extensor member.

Figure 8:
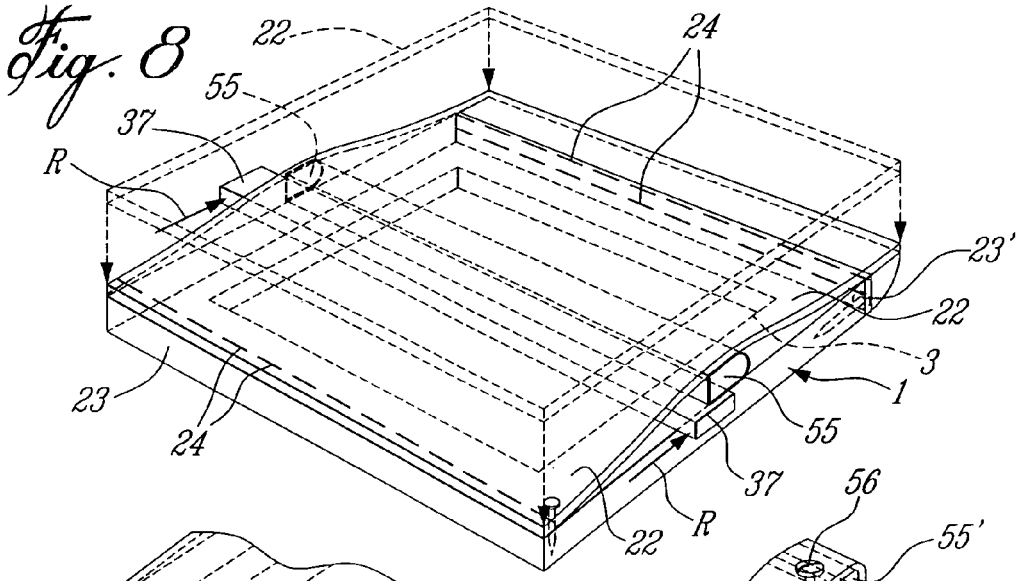
FIG. 8 is a perspective view showing the use of a single extensor for placing the elastic fabric sheet under tension.
Figure 8A:
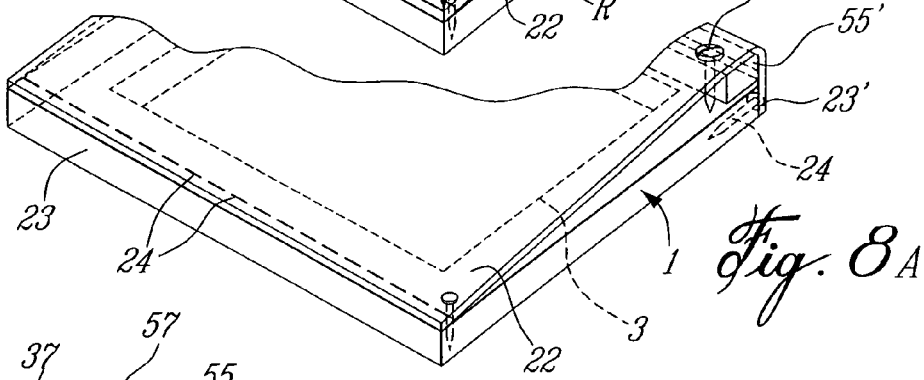
FIG. 8A is a perspective view, partly fragmented and similar to FIG. 8, showing the extensor member secured and retained by fasteners adjacent a side of the frame.
Figure 8B:
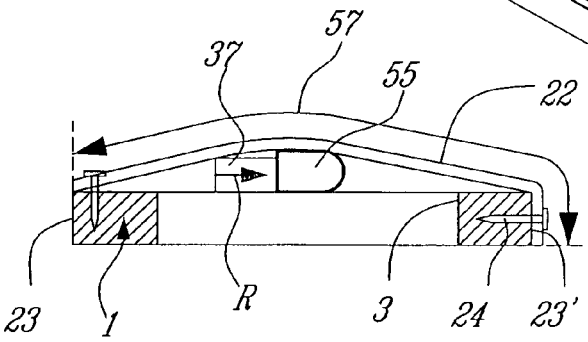
FIG. 8B is a side cross-section end view of FIG. 8.
Figure 8C:
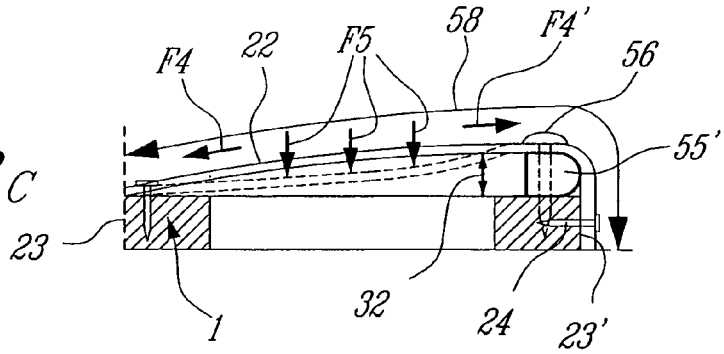
FIG. 8C is a side cross-section end view of FIG. 8A.

With reference now to FIGS. 8 to 8C, there is shown a still further embodiment wherein the support frame 1 has a single elastic fabric sheet 22 secured to a side thereof by fasteners 24 and adjacent the lateral sides 23 and 23' thereof. One end is secured to the top force of the frame adjacent the edge 23 and the other to the lateral side 23'. A single extensor 55 is herein shown to place the fabric sheet under tension and is displaced by the bar 37 in the direction of arrows R to locate it adjacent the right lateral edge 23' of the frame. Fastening screws 56 then are placed through the top of the fabric sheet and through the bar in order to secure same permanently to the frame. The single elastic fabric sheet is positioned in tension along a sloping plane sloping upwardly from lateral edge 23 to lateral edge 23'. Accordingly, the sheet is maintained under tension by the forces F4 and F4' as shown in FIG. 8C and a fabric sheet may be caused to flex by the downward load F5 with the distance 32 at the center of the frame being of course smaller than that closer to the extensor member 55 as shown at its engaged position 55'.

FIG. 9 shows a still further embodiment wherein one of the extensor members, member 62, is permanently secured to the frame 1 adjacent one of the lateral sides by fasteners 63. The other extensor 55 is disposed to its engaged position in a retention groove 24 adjacent the lateral side 23' by the displacement bar 37 whereby to place the elastic fabric sheet under tension generating stretch forces F4 and F4'. The displaceable extensor 55 when at its engaged position 55' is retained at this position by the biasing force F6 exerted by the fabric sheet against the member 55'. As hereinshown, this biasing force is an angled downward force which forces the extensor into its retention groove 61. When a load F5 is applied on the stretched fabric sheet 22, it is uniformly distributed across the sheet.

Figure 10A:
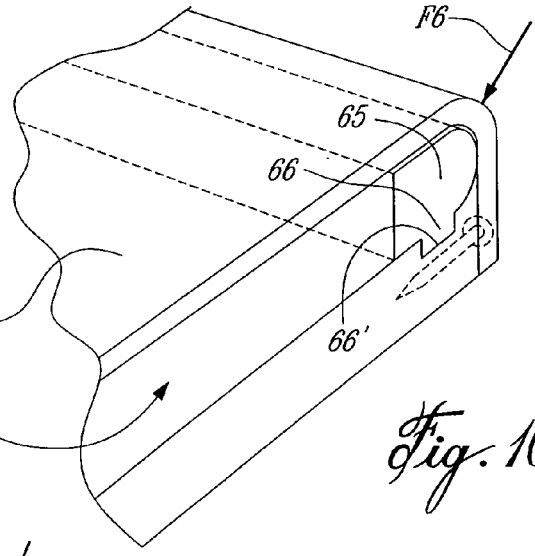
FIG. 10A is a fragmented perspective view showing a still further example of the construction of an extensor member and its retention groove.

Referring now to FIG. 10A, there is shown a further example of the construction of an extensor member. As hereinshown the extensor member 65 is an elongated rod shape member having constant cross-sectional shape. The retention means is herein constituted by a bottom tongue formation 66 which is dimensioned for close fit in a retention groove 66' formed in the support frame upper surface adjacent each of the opposed lateral sides 23 and 23' thereof. Again, the tension in the elastic fabric sheet applies a biasing force F6 against the rod-shaped member 65 to maintain the tongue formation 66 captive in the retention groove 66'.

Figure 10B:
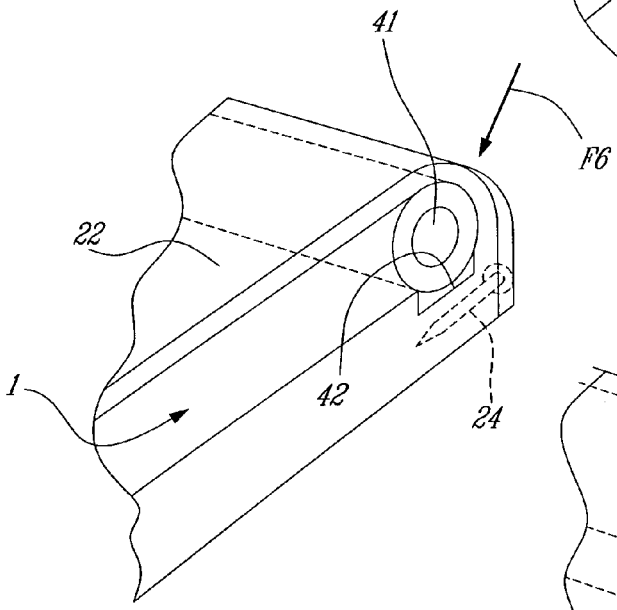
FIG. 10B is a fragmented perspective view similar to FIG. 10A but showing a tubular extensor member secured in a groove.

FIG. 10B shows a still further embodiment wherein the extensor member is a tubular member 41 as previously described and is retained in its retention groove 42 formed adjacent each opposed lateral side 23 and 23' of the frame. Again the biasing force F6 maintains this tubular member firmly engaged within the groove.

Figure 10C:
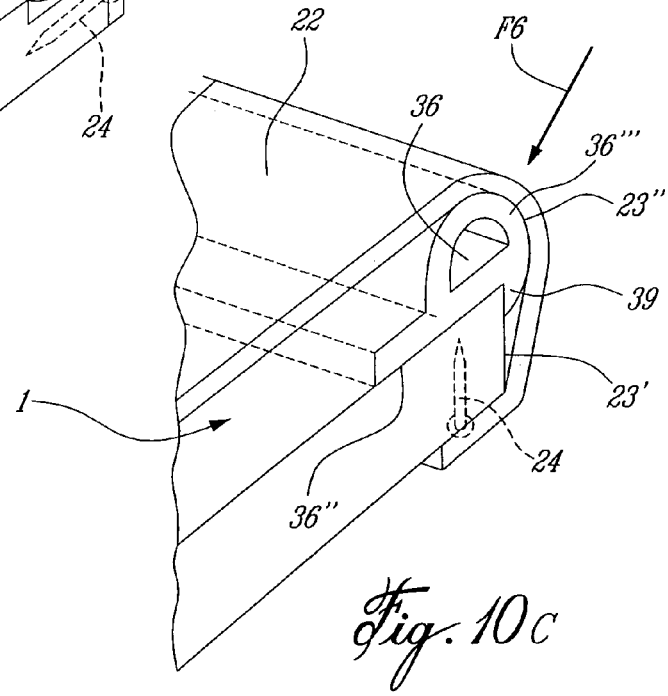
FIG. 10C is a fragmented perspective view, similar to FIG. 10A, showing the extensor of FIGS. 3A and 3B in a permanently engaged position and the manner in which the elastic fabric sheet is secured to the frame.

Finally, FIG. 10C shows the embodiment as previously described and illustrated in FIGS. 3 to 3B. As hereinshown, the extensor is formed from a cut section of a PVC extrusion. As hereinshown the extensor 36 has a flat bottom face 36" and a curved dome-shaped projecting formation 36'" which has a curvature whereby to define a smooth curved edge above the lateral sides 23 ad 23' of the frame. The hook edge formation 39 is formed integrally with the curved outer portion of the dome-shaped projecting formation and engages with the top corner 23" of the lateral edge 23'.

In conclusion, the seat and/or backrest structure of the present invention utilizing a single elastic fabric sheet placed in tension by either the frame or extensor members, or the combination thereof, creates and achieves an economic and permanently secured, firm, but flexible and elastic suspension spaced from a straight or curved structure of a chair seat or backrest frame so that the body of a person when seated or having its back resting thereon is never in contact with any hard surface but maintained in a permanent flexible suspension. A chair constructed with such structures may be made of separate or continuous straight or curved frame segments or comprised of connecting or joined together seat and backrest frames. A single elastic fabric sheet is secured to each of these frames and placed under tension and spaced from the frame as above described and illustrated by the various embodiments shown herein.

It is within the ambit of the present invention to cover any obvious modifications of the preferred embodiment described herein provided such modifications fall within the scope of the appended claims.

The invention claimed is:

1. A seat structure comprising a support frame, an elastic fabric sheet secured to said frame along opposed lateral sides of said frame and extending across a top seating portion of said frame, tensioning means to stretch said elastic fabric sheet and position same at a permanent elevated position above said seating portion sufficient to support an intended load thereon in suspension over said seating portion, said tensioning means being constituted by at least one extensor member having a length of substantially the same length as said opposed lateral sides and a cross-sectional shape for the placement of said extensor member at a predetermined location in a space between said seating portion and said elastic fabric sheet, said cross-sectional shape having a height whereby when said extensor member is slid laterally over said frame to a permanent tensioning position along one of said opposed lateral sides of said frame, said elastic fabric sheet undergoes an upward displacement in at least a part thereof and stretching to tension same to cause said elastic fabric sheet to apply a biasing force against said extensor member, and retention means to maintain said extensor member at said tensioning position.

2. A seat structure as claimed in claim 1 wherein said tension means is further provided by said support frame having a memory which, when placed in flexion from its original state, exerts a restoring force on said elastic fabric sheet to place it under tension, said support frame being placed in tension by said fabric sheet stretched by said as least one extensor member.

3. A seat structure as claimed in claim 1 wherein there are two extensor members, each extensor member being retained by a respective one of said retention means at said tensioning position adjacent an associated one of said opposed lateral sides.

4. A seat structure as claimed in claim 3 wherein said elastic fabric sheet has opposed inwardly curved end edges, said curved end edges being secured along a straight line at said opposed lateral sides of said frame, said fabric sheet when placed under tension by said extensor member exhibiting higher tension in a central region thereof than opposed side regions thereof.

5. A seat structure as claimed in claim 3 wherein said extensor members are elongated rod-shaped members of constant transverse cross-section, said retention means being constituted by a retaining formation formed with said extensor members and configured for engagement with an engageable formation of said support frame.

6. A seas structure as claimed in claim 5 wherein said retaining formation is a bottom hook edge formation formed integral with each said extensor members for hooking engagement with a top end edge of said opposed lateral side of said support frame, said top end edge constituting said engageable formation, said tension in said elastic fabric sheet applying a biasing force against said rod-shaped members to maintain said hook edge formation engaged with said top end edge.

7. A seat structure as claimed in claim 6 wherein said rod-shaped members have a flat bottom face and a dome-shaped top projecting formation, said hook edge formation projecting below said flat bottom face at an outer end thereof.

8. A seat structure as claimed in claim 5 wherein said retaining formation is a bottom tongue formation of said rod-shaped members dimensioned for close fit in a retention groove formed in a top surface of said support frame adjacent each said opposed lateral side thereof, said tension in said elastic fabric sheet applying a biasing force against said rod-shaped members to maintain said tongue formation engaged in said retention groove.

9. A seat structure as claimed in claim 3 wherein said extensor member is an elongated tubular member of constant transverse cross-section, said retention means being constituted by an elongated retention groove formed in a top surface of said support frame adjacent each said opposed lateral side thereof and dimensioned to receive and retain a lower cross-section portion of said tubular member, said biasing force against said elongated tubular member maintaining said tubular member engaged in said retention groove.

10. A seat structure as claimed in claim 9 wherein said elongated retention groove is an inwardly curved groove, said tubular member being a flexible member adapted to be deformed and positioned in said curved groove whereby to apply a variable tension in said elastic fabric sheet.

11. A seat structure as claimed in claim 3 wherein said extensor members are elongated rigid rod-shaped members, said rod-shaped members having a convexly- shaped elongated top surface wherein a center transverse portion of said rod-shaped member is thicker than opposed end transverse portions thereof, said extensor members applying a variable tension in said elastic fabric sheet.

12. A seat structure as claimed in claim 1 wherein said retention means are fastener members to immovably secure said extensor members to said support frame adjacent a respective one of said opposed lateral sides of said frame.

13. A seat structure as claimed in claim 1 wherein said support frame is concavely curved between said opposed lateral sides and defines a concave top surface, said elastic fabric sheet extending spaced above said seating portion and secured to said opposed lateral sides with said concavely curved frame placed in flexion whereby said frame exerts a restoring force to constitute said tensioning means to stretch said elastic fabric sheet over and above said concave top surface.

14. A seat structure as claimed in claim 13 wherein said support frame is a solid seat board fabricated of a material having a memory which is capable of being flexed to exert said restoring force.

15. A seat structure as claimed in claim 1 wherein said support frame is a hollow rectangularly-shaped seat frame.

16. A seat structure comprising a support frame, an elastic fabric sheet secured to said frame along opposed lateral sides of said frame and extending across a top seating portion of said frame, tensioning means to stretch said elastic fabric sheet and position same at a permanent elevated position above said seating portion sufficient to support an intended load thereon in suspension over said seating portion, said tensioning means being constituted by at least one extensor member displaceably positioned between said frame and said elastic fabric sheet to a permanent tensioning position where said elastic fabric sheet undergoes an upward displacement in at least a part thereof and stretching to tension same, and retention means to maintain said extensor member at said tensioning position, one of said extensor members being an elongated projecting ridge formation immovably positioned and extending along one of said opposed lateral sides of said frame and projecting above a top surface of said frame, and a displaceable extensor member formed as an elongated rod-shaped member and retained in a groove formed in said top surface at the other of said opposed lateral sides of said frame with said displaceable extensor member projecting above said groove, said tension in said elastic fabric sheet applying a biasing force against said rod-shaped member to maintain same engaged in said groove.

* * * * *